United States Patent [19]

Schoeffler

[11] Patent Number: 4,895,214

[45] Date of Patent: Jan. 23, 1990

[54] DIRECTIONAL DRILLING TOOL

[76] Inventor: William N. Schoeffler, P.O. Box 91105, Lafayette, La. 70509

[21] Appl. No.: 272,787

[22] Filed: Nov. 18, 1988

[51] Int. Cl.[4] ..... E21B 7/08

[52] U.S. Cl. ..... 175/38; 175/73; 175/76; 175/256

[58] Field of Search ..... 175/61, 73, 76, 92, 175/38, 107, 232, 256, 320, 202

[56] References Cited

U.S. PATENT DOCUMENTS

| | | | |
|---|---|---|---|
| 4,597,454 | 7/1986 | Schoeffler | 175/61 |
| 4,655,289 | 4/1987 | Schoeffler | 166/320 |
| 4,655,299 | 4/1987 | Schoeffler | 175/38 |
| 4,732,223 | 3/1988 | Schoeffler et al. | 175/256 |
| 4,811,798 | 3/1989 | Falgout, Sr. et al. | 175/73 |

FOREIGN PATENT DOCUMENTS

| | | | |
|---|---|---|---|
| 969881 | 10/1982 | U.S.S.R. | 175/61 |

*Primary Examiner*—Jerome W. Massie, IV
*Assistant Examiner*—Terry Lee Melius
*Attorney, Agent, or Firm*—John D. Jeter

[57] ABSTRACT

An improved directional drilling tool permits changing the downhole drilling assembly between straight and directional drilling configuration by manipulation of conventional drilling fluid flow controls at the surface. A housing, with stabilizer features, shrouds a shaft which functions as an extension of the drill string and attaches to a drill head. A drilling fluid flow rate responsive selector valve is situated in the shaft and responds to drilling fluid flow rate manipulations to change assembly configuration. In the straight configuration the shaft remains straight and is rotationally locked to the housing. In the directional configuration the housing is rotationally unlocked from the shaft, normally after directional orientation, so that the shaft can rotate through it. The same action transversely displaces the shaft midsection relative to the housing and the shaft and drill head below is angularly deflected by way of a hinge arrangement near the drill head end of the housing. The process can be reversed for straight drilling by further drilling fluid flow rate manipulations.

8 Claims, 2 Drawing Sheets

DIRECTIONAL DRILLING TOOL

This invention pertains to downhole apparatus for use just above the drill head on a drilling fluid conducting drill string in a well being drilled to influence the path to be followed by the progressing drill head. More specifically, the invention pertains to apparatus responsive to selective manipulations of drilling fluid flow controls, at the surface, to change the downhole assembly between straight and directional drilling configuration.

BACKGROUND OF THE INVENTION

Directional well drilling practices are well known in the well drilling art. Directional drilling is often necessary to prevent unwanted well bore deviation and often economically advantageous in producing well bores that reach laterally from the drilling site to the production zone.

Devices used just above the drill head to cause lateral deflection of the well bore being drilled have progressed from primitive to complex in the years of expansion of the use of downhole motors and Measurement While Drilling (MWD) instrumentation. Such evolution has been a slow process, each step of which is well known to those skilled in the well drilling art.

Conventional drilling practices require tripping the drill string to change the drill head. For many years a common drill head might last no more than thirty hours. The frequent inevitable tripping of the drill string made servicing the downhole assembly used for directional control a minor burden. Drill heads, both diamond and roller, may now last over two hundred hours. Special drill string trips to change directional control apparatus is now parasitic to the system. There is an understandable urge to develop downhole apparatus that will allow change of downhole apparatus between straight and directional drilling configuration without tripping the drill string.

Changing the configuration of the downhole drilling assembly has been made possible without tripping the drill string by the use of wire line tools run down the drill string bore. This too takes time and causes some problems, some of which are dangerous. It is very desirable to do the same thing by manipulation of drilling fluid flow controls that are always present. Downlink command of configuration change by way of flow controls places no additional technical burden on surface gear and little additional technical burden on operating personnel.

It is therefore an object of this invention to provide a downhole drill string deflecting apparatus to change between straight drilling and directional drilling configuration in response to preselected manipulations of drilling fluid flow controls at the surface.

It is a further object of this invention to provide a remote control selector valve that is responsive to preselected drilling fluid flow manipulations to direct the action of the downhole deflecting machinery so that the change between the two configurations may be repeatedly exercised.

It is yet another object of this invention to provide apparatus that will produce a drilling fluid pressure drop in the apparatus that is representative of the configuration of the apparatus downhole.

SUMMARY OF THE INVENTION

An improved directional drilling tool responds to manipulation of drilling fluid flow controls at the surface to change the downhole assemble between straight drilling configuration and directional drilling configuration. A housing encloses a torque passing assembly that has flexible joints that permit the torque passing assembly to rotate within the housing with a lower output shaft rotating about a deflected centerline to drive an attached drill head.

Drilling fluid is conducted from the drill string through a channel extending through a bore in the torque passing assembly to the drill head. A remote control selector valve in the bore responds to preselected amounts of drilling fluid flow rate increase to change the resistance to flow of drilling fluid through the bore. On each occasion of the preselected amount of flow rate increase, the valve responds to change between a low flow resistance and a high flow resistance.

An actuator in the torque passing assembly responds to high flow resistance in the valve to move a cam arrangement to urge a portion of the torque passing assembly, between two flex joints, radially from the housing centerline. When the selector valve has low flow resistance, a spring moves the cam arrangement to force the torque passing assembly to straightness within the housing, on the housing centerline.

When the portion of the torque passing assembly is moved radially, a gimbal arrangement on the output shaft serves as a fulcrum to cause the rotational centerline of the output shaft to be angularly deflected from the centerline of the housing. The housing has well bore wall engagement surfaces to align the housing and well bore, hence, the deflected output shaft is deflected from the well bore centerline.

When the valve has not caused the actuator to move and the spring controls the cam arrangement, a rotational lock on the torque passing assembly engages a cooperating lock on the housing and the entire tool rotates as a length of the drill string.

The valve is in the drilling fluid circuit and flow resistance in the valve is reflected in the total standpipe pressure at the surface and can be used to determine the configuration of the tool downhole.

Before the drilling fluid controls at the surface are actuated to place the downhole tool in the directional drilling configuration the tool is commonly oriented azimuthally relative to earth. The orientation processes are in common use and well known to those in the drilling art. After orientation, the selector valve is actuated by manipulation of drilling fluid flow controls and the housing is rotationally decoupled from the torque passing assembly, and hence the drill string, and the housing remains rotationally stationary while the deflected output shaft rotates with the drill string for directional drilling.

BRIEF DESCRIPTION OF DRAWINGS

In the drawings wherein like features have like captions.

DETAILED DESCRIPTION OF DRAWINGS

Figure 1:
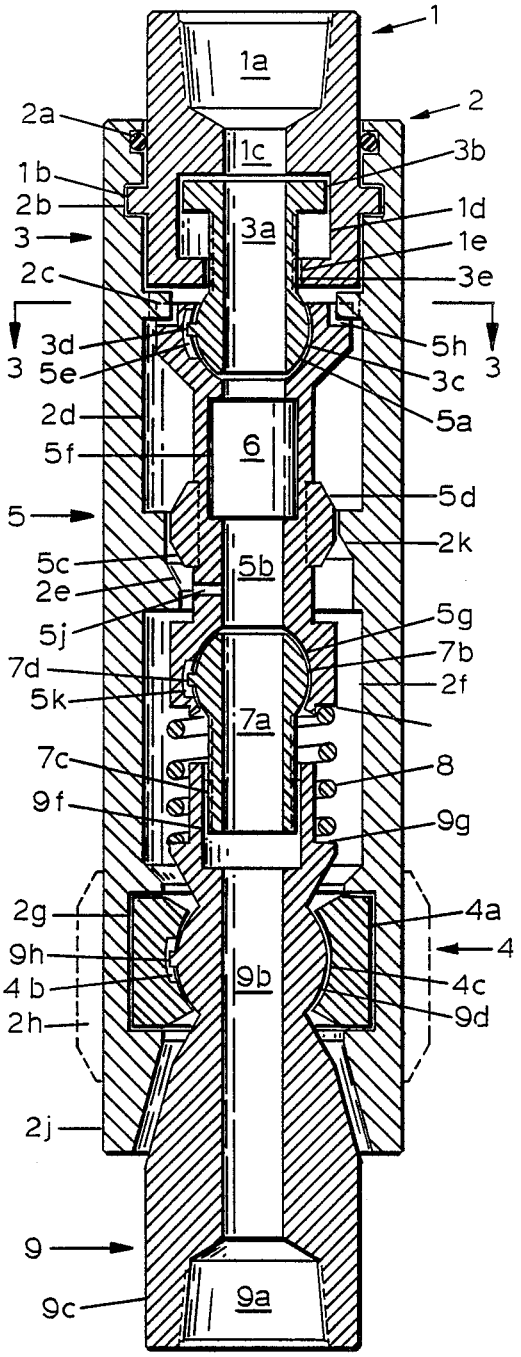
FIG. 1 is a side sectional view of the preferred embodiment in the straight drilling configuration.

Bearings and seals on downhole drilling machinery are an art in themselves and no point of novelty in this disclosure bears thereon. In some downhole machinery, bearings run in mud, some operate in an oil filled general enclosure, and some bearings are separately sealed. Bearings and seals shown in the drawings are conceptually adequate to demonstrate ability to practice the art disclosed but may be regarded as symbolic. Seal details are not shown but closures subject to contact or labyrinth sealing are simply captioned s.

In the interest of descriptive clarity, features of manufacturing and maintenance utility, such as threaded connections and the like, are omitted unless they bear on points on novelty. For convenience it may be assumed that the various machine shapes are assembled by appropriate welding.

Figure 2:
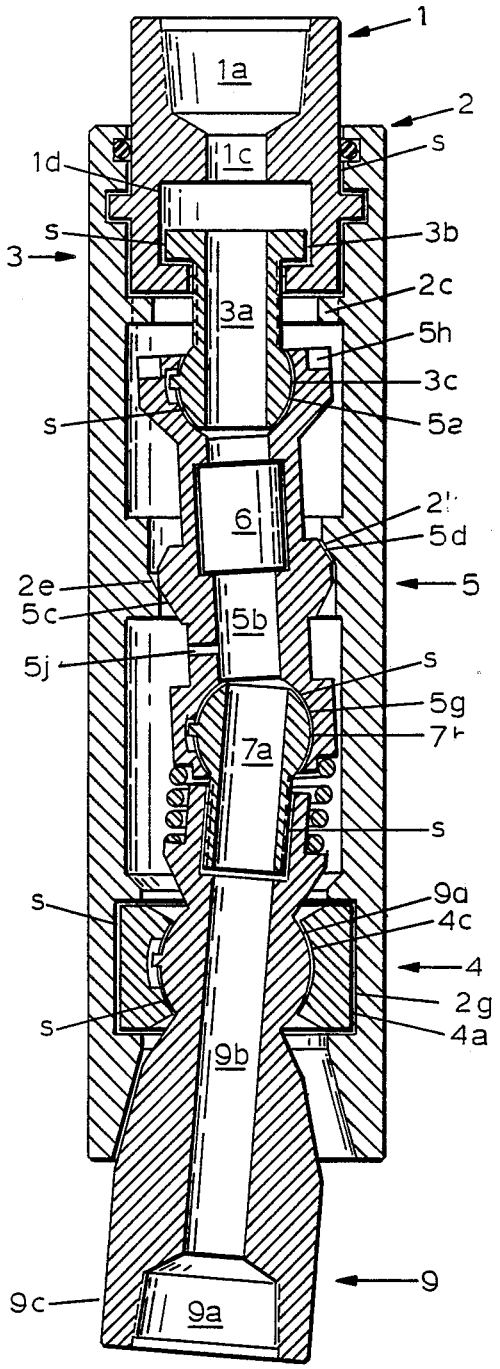
FIG. 2 is a view identical to that of FIG. 1 with the tool actuated to the directional drilling configuration.

FIGS. 1 and 2 are essentially identical with fig. 1 showing the straight drilling configuration and FIG. 2 showing the directional drilling configuration. The deflection angle of FIG. 2 is exaggerated. The actual deflection angle is usually less than two degrees.

Valve 6, in opening 5*f*, is too small for detailed description on the scale of FIGS. 1 and 2 and is described later. For FIG. 1, valve 6 is open and fluid pressure in channels 3*a*, 5*b*, 7*a*, and 9*b* is approximately the same. In FIG. 2, valve 6 is actuated to resist fluid flow and fluid pressure in channel 3*a* is higher than fluid pressure in channel 5*b*.

Input shaft 1 has tool joint box 1*a* for fluid tight connection to an upwardly continuing portion of a drill string. The input shaft is rotationally coupled to output shaft 9 by way of female spline 1e and cooperating male spline 3*e*, flex joint drive pin 3*d* and cooperating arcuate slot 5*e*, arcuate slot 5*k* and cooperating flex joint drive pin 7*d* and, finally, male spline 7*c* and cooperating female spline 9*f*. The entire assembly of FIG. 1 rotates together when rotationally driven by the upwardly continuing portion of the drill string because spring 8 has pushed the midsection 5 upward causing lock lugs 5*h* to engage slots in lock flange 2*c*. The straightness of midsection 5 is assured by the engagement of cam 5*d* and cam 2*k*. The entire assembly performs as a length of drill string and in the configuration of FIG. 1, normal drilling continues.

Drilling fluid flows, generally unresisted, through channels 1*c*, 3*a*, 5*b*, 7*a*, 9*b* and into the bore of a downwardly continuing portion of a drill string component attached with fluid tightness to tool joint box 9*a*. The downwardly continuing drill string may comprise only a drill head.

Mid-section shaft 5 can move a limited amount axially relative to the housing, input shaft 1, and output shaft 9. The movement is enabled by slip joints provided by splined pair 1*e* and 3*e* and by splined pair 7*c* and 9*f*. Downward movement of the mid-section shaft is caused by piston 3*b* when fluid pressure in channel 3*a*, in fluid communication with the upper face of the piston, exceeds fluid pressure in channel 5*b*, communicated to the lower face of the piston by way of vent 5*j* and the housing general enclosure, by an amount sufficient for the piston to overcome spring 8.

FIG. 2 shows the mid-section shaft moved downward in response to fluid flow restricting action of valve 6 in response to drilling fluid flow manipulations to be described later herein.

When it is desirable to deflect the well bore, as drilling proceeds, valve 6 is caused to actuate by processes yet to be described. Before valve 6 is actuated, the drill string is normally rotated until the downhole assembly is azimuthally oriented relative to earth by MWD procedures well known to those skilled in the drilling art. When valve 6 is actuated, fluid flow therethrough is resisted and fluid pressure in channel 5*b* is reduced relative to that in channel 3*a*. Vent 5*j* feeds pressure from channel 5*b* into the housing general enclosure and causes a pressure differential across piston 3*b*. Piston 3*b* moves downward in cylinder 1*d*, compressing spring 8. Lock lug 5*h* is moved out of engagement with lock flange 2*c*. Housing 2 now has no rotational drive and remains stationary while the torque passing assembly inside rotates with the drill string. Optional stabilizer blades 2*h* engage the well bore wall.

When midsection 5 moves downward, cam 5*c* engages cam 2*e* and forces the midsection to the right. In effect, these cams move the midsection and the housing in opposite radial directions. The gimbal formed by ball 9*d* and socket 4*c* becomes a fulcrum and the output shaft is angularly deflected from the housing centerline. The housing is on the same centerline as the input shaft 1 which is journaled to the housing.

Shaft 9 has drive pin 9*h* in arcuate slot 4*b* and bearing surface 4*a* rotates in bearing box 2*g* about the housing centerline. If the housing is not rotating and torque passing elements are rotating, cam 2*e* displaces the midsection in a fixed radial direction relative to earth. The center of ball 7*b* is a fixed point and the shaft 9*c* rotates about a fixed deflected centerline.

The cams 5*c* and 5*d* are shown on a shaft enlargement with dotted lines symbolizing a bearing arrangement. If the housing is mud filled, the bearing is needed. If the housing is oil filled, some arrangements are best run without the bearing so that cams 5*c* and 5*d* rotate against the cooperating cam surfaces.

Baring flange 2*b* and bearing box 1*b* represent a journal and thrust bearing arrangement that assures a coaxial relationship between shaft 1 and housing 2. Flex joint ball 3*c* and socket 5*a* have centers on the housing centerline. Gimbal ball 9*d* and gimbal socket 4*c* have centers on the housing centerline and the centers are axially located in the housing by bearing block 4*a* in bearing box 2*g*. Actuate 3 moves axially but stays on the housing centerline. Seal 2*a* is not necessary if the housing is mud flooded. By-pass flow resistance may be adequate and is captioned in FIG. 2.

Openings 2*d* and 2*f* are in fluid communication because the cam arrangement does not inhibit fluid flow therebetween.

The housing may be similar, externally, to a square drill collar. In that case, stabilizer blades 2*h* would be omitted and housing end 2*j* would accomplish well bore and housing alignment.

Figure 3:
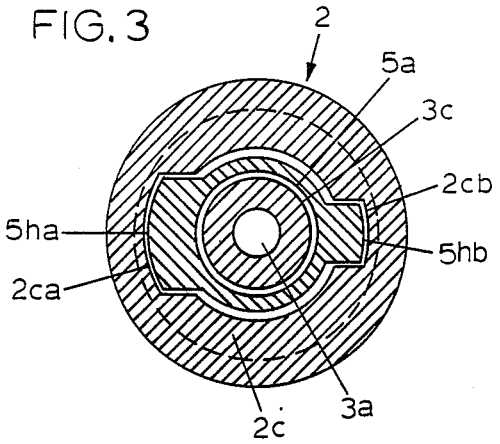
FIG. 3 is a sectional view taken along line 3—3 of FIG. 1.

FIG. 3 shows lock flange 2*c* in housing 2. Locking lugs 5*h* comprise a wide lug 5*ha* and a narrow lug 5*hb*. The torque passing assembly can be locked to the housing in only one rotational position where lug 5*ha* enters flange opening 2*ca* and lug 5*hb* enters opening 2*cb*.

Figure 4:
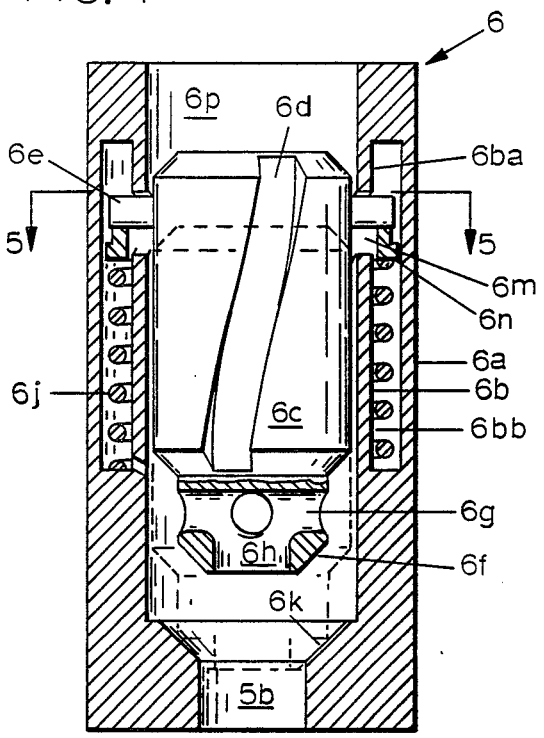
FIG. 4 is a side elevation, rather enlarged and mostly cut away, of the valve 6 of FIGS. 1 and 2.

In FIG. 4, valve 6 is shown to have poppet 6*c* situated in the bore of sleeve 6*b*. Poppet 6*c* is free to rotate and move axially within limits. Axial travel is limited by pins 6*e* moving in serpentine guideway 6*m*, better shown in the development of FIG. 6. Coaxial sleeves 6*a* and 6*b* are radially spaced to provide an annular space for spring 6*j* and spring collar 6*n*. Spring 6*j*, by way of collar 6*n*, urges pins 6*e* and the connected poppet 6*c* upward. Pins 6*e* slide on collar 6*n* to allow the poppet to rotate in a path dictated by serpentine groove 6*m*.

Fluid flowing downward in channel 3*a* enters bore 6*p* of valve 6 and urges poppet 6*c* downward. Some fluid may flow past the poppet periphery but most will flow through turbine channels 6*d*. The channels 6*d* are spiral in shape and reaction to fluid flow produces forces that tend to rotate the poppet counterclockwise when viewed from the top. fluid flowing through the channels continue through channel 5*b* when the valve is open as shown. The valve can move downward under conditions to be described alter and surface 6*f* engages seat surface 6*k* and block the previous fluid route to channel 5*b*.

When the poppet is fully downward, fluid flowing through channels 6*d* enters holes 6*g* and flows through orifice 6*h*. The orifice is sized to give a preselected pressure differential between channels 6*p* and 5*b* which produces the differential between channels 3*a* and 5*b* previously described. Dashed lines show the poppet outline in the downward position.

Figure 5:
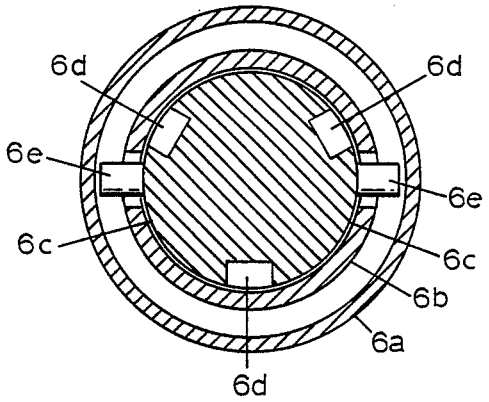
FIG. 5 is a sectional view taken along line 5—5 of FIG. 4.

FIG. 5 shows diametrically opposite pins 6*e* and the relationship of the three channels 6*d*.

Figure 6:
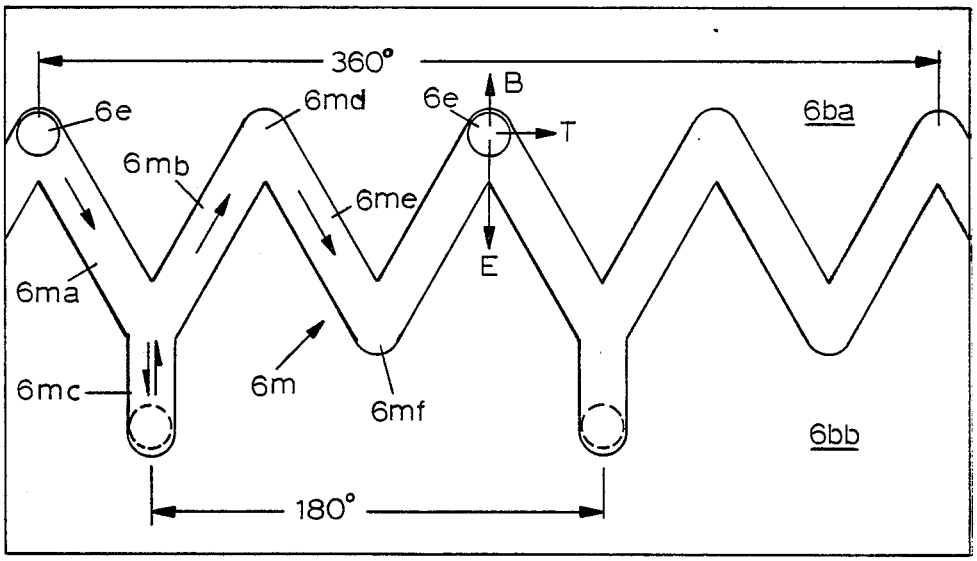
FIG. 6 is a development, further enlarged, of the outer surface of sleeve 6*b* of FIG. 4.

FIG. 6 is a development of the outer surface of sleeve 6*b* which is cut in two by the serpentine groove 6*m* to form upper sleeve portion 6*ba* and lower portion 6*bb*. The development is viewed toward the centerline. Forces on pins 6*e* are shown by arrows. Bias force B is produced by spring 6*j*. Entrainment force E is produced by the action of the downward flowing fluid upon the poppet. Torque force T is produced by the turbine effect of slots 6*d*. there are two pins but the movement description will address only the left pin. Starting with the left pin 6*e*, the upward position shown results from spring force only. Fluid flow produces both E and T forces in preselected proportion and the pin moves along groove component 6*ma* and down into groove component 6*mc*. At this low point, poppet 6*c* will reach seat surface 6*k* and the tool will be actuated to the directional configuration by processes previously described herein. The tool and valve will stay actuated until fluid flow is reduced enough for bias force B to exceed Force E.

When fluid flow is reduced below a preselected amount, pins 6*e* move upward. Pins 6*e* move along groove component 6*mb* as shown by the arrow therein. Some amount of force T remains as long as the pin is below portion 6*md*. At some low flow rate, the pins are at portion 6*md*.

When flow is again increased, forces E and T move the pins down portion 6*me* in the direction of the arrow. The pins then stop at portion 6*mf* and do not move down far enough for the poppet to reach seat surface 6*k* and the tool stays in the straight configuration while fluid flow and drilling continues.

With the preferred serpentine form of the groove shown, the tool will change alternately between straight and directional configuration in response to reduction of flow and subsequent increase of flow of preselected amounts and will do so continuously as long as the process is repeated.

Groove 6*m* can be of many serpentine forms. The poppet can be stopped before reaching the seat a number of times before being allowed to reach the seat and may be allowed to reach the seat any number of times before being stopped above the seat. By way of description then, the valve responds to drilling fluid flow increases within a preselected flow rate range to produce a mechanical signal. The mechanical signal is the movement of the poppet. The poppet movement produces an output signal in the form of a pressure differential across the poppet. The output signal characteristics, low pressure differential if the poppet is stopped above the orifice and high pressure differential if the poppet is allowed to reach the orifice, is determined by the number of times the drilling fluid flow rate is increased by the preselected amount. In effect, then, the tool assumes the straight drilling configuration in response to drilling fluid flow rate manipulations of a first characteristic and assumes the directional drilling configuration in response to drilling fluid flow rate manipulations of a second (or any other than the first) characteristic.

From the foregoing, it will be seen that this invention is one well adapted to attain all of the ends and objects hereinabove set forth, together with other advantages which are obvious and which are inherent to the method and apparatus.

It will be understood that certain features an subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. A well bore deviation control tool for use on a fluid conducting drill string in a well being drilled, the tool comprising:

(a) an elongated generally cylindrical housing having an upper end, a lower end, and a generally centerline;

(b) a torque passing assembly extending along said general centerline, arranged for rotating therein and comprising, an input shaft journaled for rotation on said general centerline and having means for fluid tight attachment to an upwardly continuing portion of a drill string, an output shaft bearingly supported for rotation in said housing and extending from said lower end thereof with means for fluid tight attachment to a downwardly continuing portion of the drill string, a rigid mid-section shaft rotationally coupled by flexible joints between said input shaft and said output shaft, and at least one drilling fluid channel extending longitudinally through said assembly;

(c) well bore wall engagement surfaces on said housing to generally align said housing and the well bore;

(d) selector valve means situated in said channel and arranged to variably resist drilling fluid flow therethrough, responsive to drilling fluid flow rate changes of a first characteristic to produce a first fluid flow resistance when drilling fluid flow rate is increased a preselected amount and responsive to drilling fluid flow rate changes of other characteristics to produce a higher fluid flow resistance than said first fluid flow resistance when drilling fluid flow is increased said preselected amount;

(e) actuator means situated in said assembly, responsive to fluid flow resistance across said valve to move from a first position to a second position in response to said higher fluid flow resistance than said first fluid flow resistance;

(f) bias means situated on said assembly and arranged to move said actuator to said first position in response to said first fluid flow resistance;

(g) lateral displacement means mounted on said assembly, and responsive to movement of said actuator means to move said mid-section shaft a preselected radial distance relative to said housing when said actuator moves to said second position;

(h) gimbal mounting means in said housing arranged to rotationally support said output shaft for rotation about an angularly deflected axis relative to said centerline, said gimbal mounting means to serve as a fulcrum to deflect said angularly deflected axis when said mid-section shaft is moved said radial distance; and (i) rotational coupling means, responsive to said positions of said actuator means, arranged to rotationally couple said assembly to said housing when said actuator is in said first position and to rotationally decouple said assembly from said housing when said actuator is in said second position.

2. The tool of claim 1 wherein said actuator means comprises a variable volume actuator chamber with fluid communication channels to opposite fluid flow related sides of said valve.

3. The tool of claim 1 wherein said lateral displacement means comprises a first cam mounted for movement on said assembly , responsive to movement of said actuator, and is arranged to engage a cooperating cam surface on said housing to move said mid-section said radial distance.

4. The tool of claim 3 wherein said first cam has a first cam surface arranged to produce said radial displacement when said actuator is in said second position and a second cam surface arranged to engage a cooperating surface on said housing to move said mid-section shaft to a generally central position when said actuator is in said first position.

5. The tool of claim 1 wherein said gimbal mounting means comprises a bearing arranged for radial and axial support of said output shaft in said housing and has a spherical socket to support a cooperating spherical surface on said output shaft to accommodate rotation of said output shaft about an axis angularly deflected from said centerline.

6. The tool of claim 1 wherein said rotational coupling means is arranged to rotationally couple said assembly to said housing only when said assembly has a preselected rotational orientation relative to said housing.

7. The tool of claim 6 wherein said rotational coupling means comprises at least one element on said assembly that interdigitatingly engages a cooperating element on said housing and said interdigitating element is arranged to be compatible with said cooperating element only when said assembly is in a preselected rotational orientation relative to said housing.

8. The tool of claim 1 wherein said housing has radially extended stabilizer surfaces to engage the well bore wall.

* * * * *